United States Patent [19]

Wilson

[11] Patent Number: 5,037,332

[45] Date of Patent: Aug. 6, 1991

[54] INTERMODULE ELECTRICAL COUPLING

[75] Inventor: Albert H. Wilson, Los Angeles, Calif.

[73] Assignee: ITT Corporation, New York, N.Y.

[21] Appl. No.: 564,472

[22] Filed: Aug. 7, 1990

[51] Int. Cl.[5] ..... H01R 13/658

[52] U.S. Cl. ..... 439/608; 439/654; 439/931

[58] Field of Search ..... 439/65, 66, 74, 75, 439/608, 581, 723, 724, 931, 654; 361/412, 413; 324/158 P, 158 F; 29/876, 884, 885

[56] References Cited

U.S. PATENT DOCUMENTS

| | | | |
|---|---|---|---|
| 2,163,412 | 6/1939 | Schneider | 173/330 |
| 3,744,128 | 7/1973 | Fisher et al. | 29/629 |
| 3,757,276 | 9/1973 | Kailus | 339/143 |
| 3,958,851 | 5/1976 | Evans | 339/47 |
| 3,999,830 | 12/1976 | Hermann, Jr. et al. | 339/136 |
| 4,574,236 | 3/1986 | Hechtman | 324/158 P |
| 4,712,849 | 12/1987 | Seidel et al. | 439/607 |
| 4,724,180 | 2/1988 | Kern | 428/131 |
| 4,734,046 | 3/1988 | McAllister | 439/581 |

OTHER PUBLICATIONS

IBM Bulletin, Peter, vol. 22, No. 2, p. 523, 7-1979.

*Primary Examiner*—Neil Abrams
*Attorney, Agent, or Firm*—Thomas L. Peterson

[57] ABSTRACT

An electrical coupling is provided which has a dielectric body with numerous contact-holding holes, which provides electromagnetic shielding between contacts in a simple and low cost construction. The body (20, FIG. 3) has through holes extending between its opposite faces, and has a metal plating (34) which covers the walls of the holes as well as at least a portion of a face to interconnect all of the hole platings. A plurality of dielectric bushings (54, 56) lie in many of the holes to prevent contacts (36) in the holes from touching the plating on the walls of the holes. At least one of the holes not occupied by one of the bushings, holds a metal grounding device (60) securely connected to the plating on the hole wall and forming a contact for connecting to a grounded terminal (16G).

8 Claims, 4 Drawing Sheets

FIG. 4
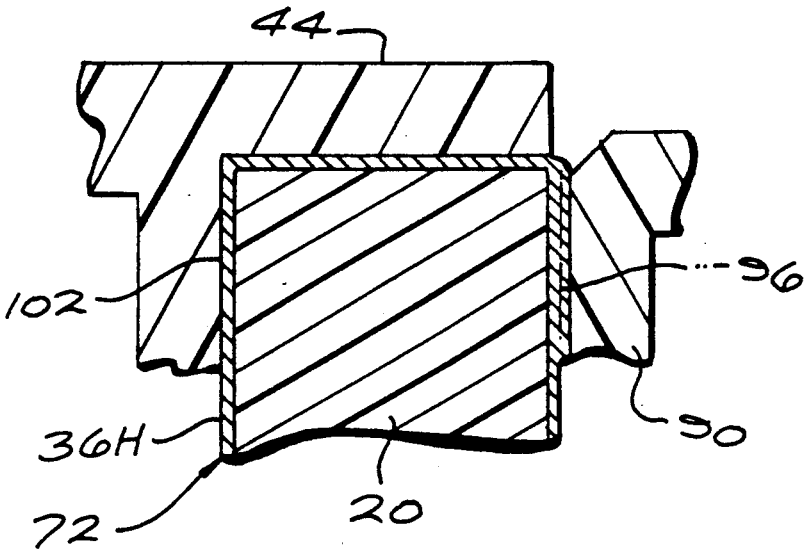
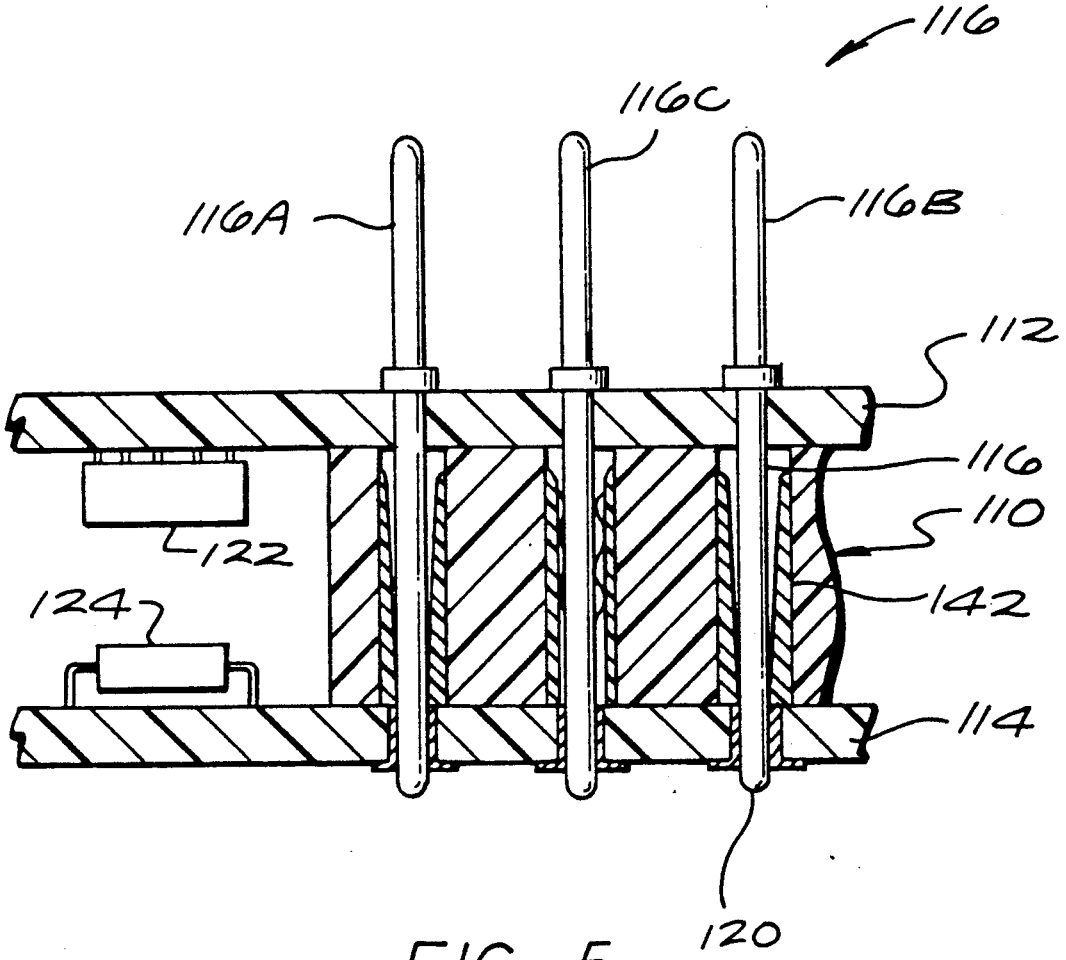
FIG. 5

INTERMODULE ELECTRICAL COUPLING

BACKGROUND OF THE INVENTION

Electrical couplings which pass high frequency signals often require a metal electromagnetic shield between contacts to minimize cross-talk between adjacent contacts. One approach has been to place the contacts within dielectric tubes of a body, and to place thin metal strips between the tubes, with the strips being bent in a zig-zag fashion to completely surround each of the contact-holding tubes. This approach is fairly expensive because of the time required to mount the plates and the high rework rate that is encountered. An electrical coupling for holding numerous contacts, which provided a grounded metal shield around each of the contacts to shield it from other contacts, in a simple and low cost construction, would be of considerable value. An important application of such electrical couplings is as intermodule stack connectors for interconnecting a pair of modules having projecting pin contacts, and a low cost shielded connector for such applications would be especially useful.

SUMMARY OF THE INVENTION

In accordance with one embodiment of the present invention, an electrical coupling is provided for receiving numerous contacts, which provides an electromagnetic shield around each of the contacts in a low cost construction. The coupling includes a body of dielectric material having opposite faces and having holes for receiving contacts. A conductive plating plates the walls of the holes and at least a portion of one of the faces to interconnect the platings in the holes. With a source of ground potential connected to the plating, the walls of all of the plated holes are grounded and serve as electromagnetic shields. A plurality of dielectric bushings lie in a plurality of the holes, to keep the contacts lying in the holes spaced from the plated walls of the holes. A large number of holes can be plated, and bushing inserted, at low cost to provide a low cost coupling with good electromagnetic shielding around each of the locations where a contact is received.

The plating can be grounded by a grounding device lying in one of the plated holes, which has a contact for connection to an inserted terminal at ground potential, and which is securely connected to the plating of the hole.

The bushings can be held on a dielectric plate to form a bushing device, with the bushings and plate preferably being integrally molded. Two bushing devices can be used, whose plates lie over the opposite faces of the body, and with the bushings projecting into the opposite ends of the holes. The two bushings in each hole can trap a contact between them.

The novel features of the invention are set forth with particularity in the appended claims. The invention will be best understood from the following description when read in conjunction with the accompanying drawings.

BRIEF DESCRIPTION OF THE DRAWINGS

FIG. 4 is an enlarged view of the area 4—4 of FIG. 3.

FIG. 5 is a sectional view of an intermodule stacking coupling constructed in accordance with another embodiment of the present invention, shown being used to couple a pair of modules.

DESCRIPTION OF THE PREFERRED EMBODIMENTS

Figure 1:
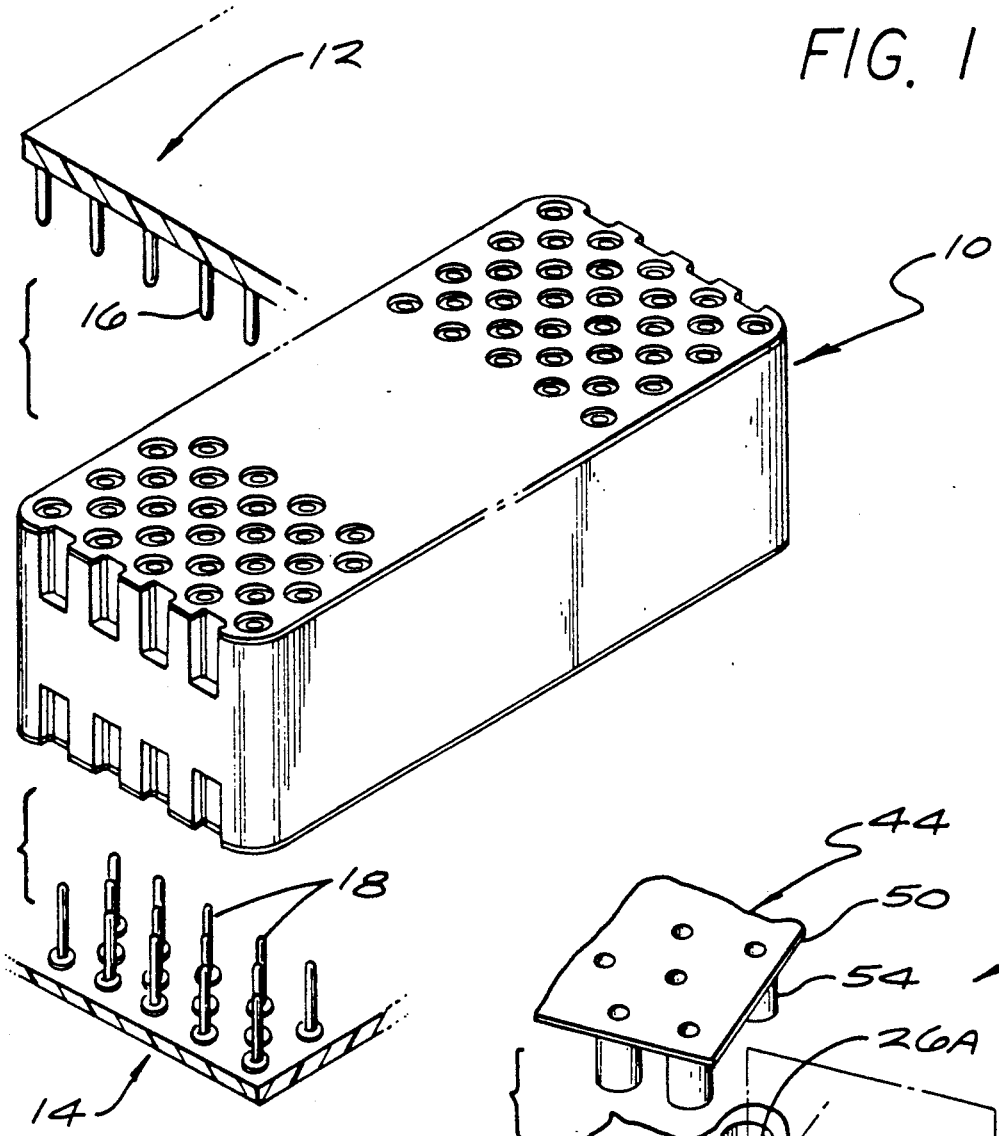
FIG. 1 is perspective view of an electrical coupling which is useful as an intermodule stacking connector, and showing portions of modules that can be interconnected by the coupling.

FIG. 1 illustrates an intermodule stacking coupling 10 which is useful to connect first and second modules 12, 14. The modules have pin contacts 16, 18 which are inserted into holes at the opposite faces of the coupling, where corresponding pins 16, 18 of the two modules are interconnected. In one example, the coupling 10 is used to connect a pair of modules in the form of circuit boards having components on their surfaces, where the boards must be kept spaced from one another when interconnected, to provide space for the components.

Figure 2:
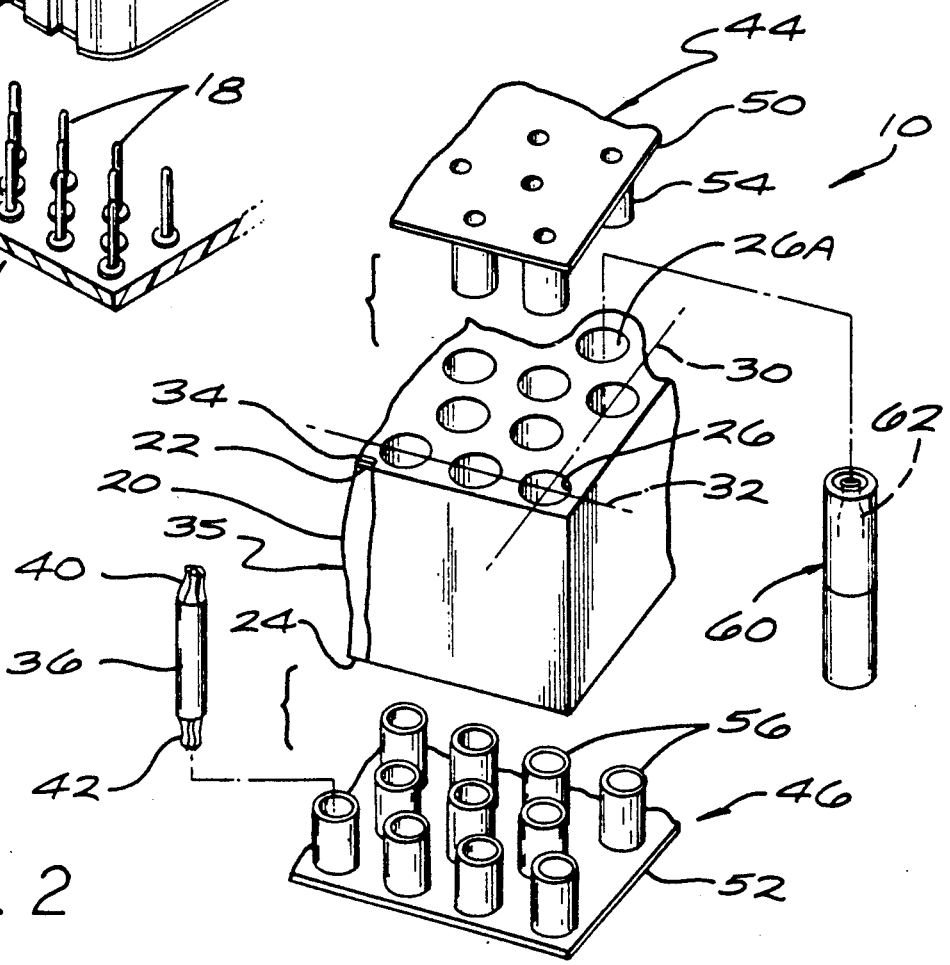
FIG. 2 is a partial perspective exploded view of the coupling of FIG. 1.

As shown in FIG. 2, the coupling 10 includes a body 20 of insulative material having opposite first and second faces 22, 24. The body has a multiplicity of through holes 26 extending between its opposite faces, the holes being arranged in multiple rows 30 and columns 32. A plating 34 of conductive material plates the entire surface of the body, including the walls of the through holes 26. The combination of the insulative body 20 and plating 34 forms a body device 35. A large number of signal socket contacts 36 lie in the plated holes of the body to carry high frequency signals. The socket contacts have sockets 40, 42 at their opposite ends for connecting to the pins 16, 18 of the modules to interconnect pairs of such pins. First and second bushing devices 44, 46 are provided, that each includes a plate 50, 52 that can lie over one of the faces of the body, and that each have multiple dielectric bushings 54, 56 that can project into the plated holes 26. The bushings surround the opposite ends of the socket contact 36 to keep it from touching the plated holes of the body. The plate such as 50 merely holds the bushings together, and its shape is not important.

A grounding device 60 lies in at least one of the holes 26A. The grounding device has a grounding socket 62 which can receive one of the first module contacts 16 which is electrically grounded. The grounded socket 62 is electrically connected through the outside of the grounding device, to the plating on the walls of the hole 26A. Thus, the plating on the walls of the hole 26A is grounded, to thereby ground the entire plating 34. It should be noted that the term "ground" refers to a substantially constant electrical potential, which may be at the potential of the earth or at some other potential, with the potential changing very slowly or not at all with respect to the rapid changes of potential on socket contacts 36 that carry high frequency signals.

Figure 3:
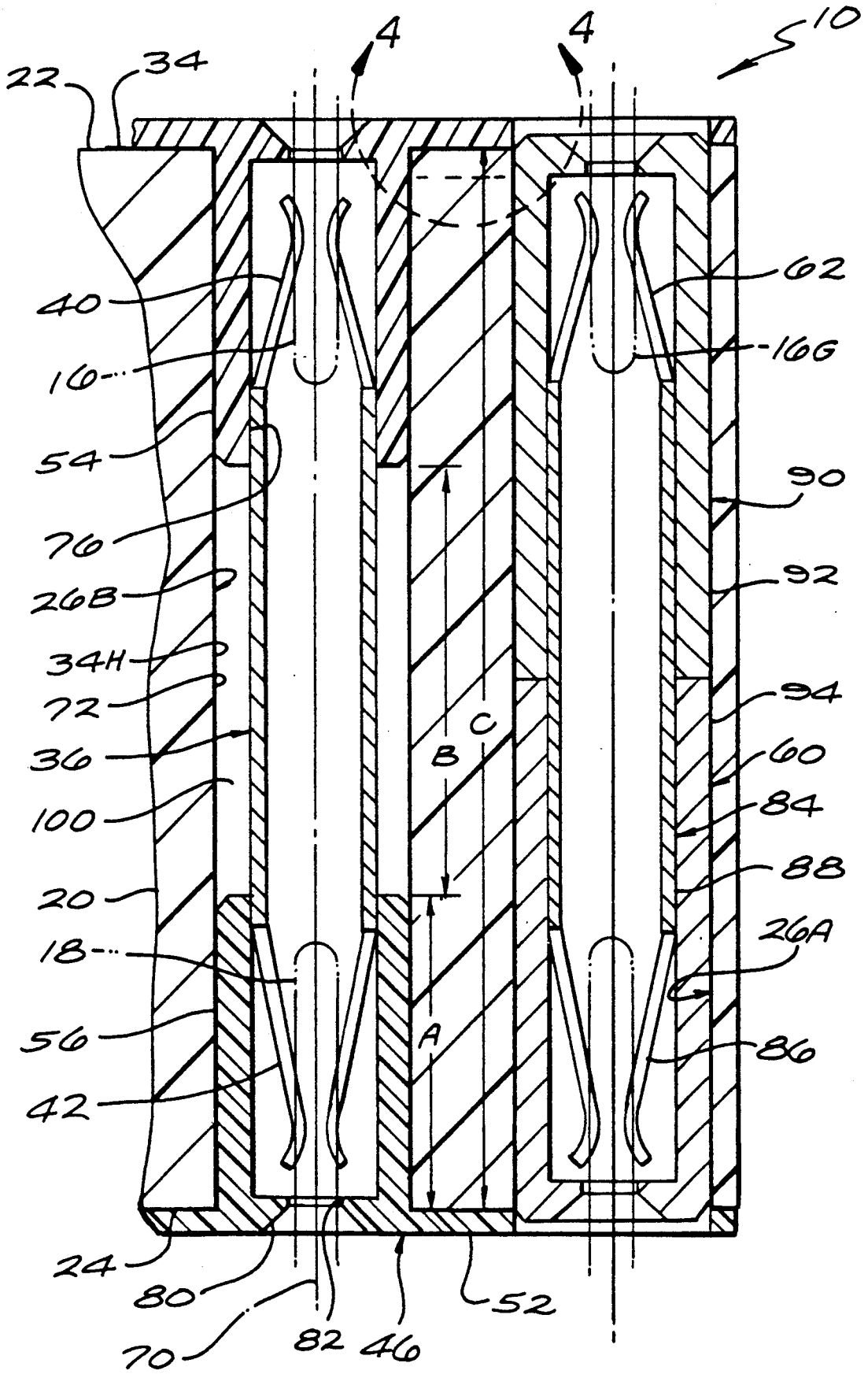
FIG. 3 is a partial sectional view of the coupling of FIG. 2.

As shown in FIG. 3, the signal socket contact 36 and the hole 26B in which the contact lies have concentric axes indicated by axis 70. The bushings 54, 56 keep the socket contact 36 away from the plating portion 34H which plates the internal walls of the body to form plated walls at 72. Since the plated walls 72 are grounded, they form electromagnetic shields that isolate the contact 36 from the other numerous contacts of the coupling, to prevent contact to contact interference. The bushings prevent direct engagement of the socket contact 36 with the plated walls which could "short circuit" the socket contact. The construction results in passages 76 through the body device that are each surrounded by an electromagnetic shield but which are isolated from direct contact with the shield.

Each of the bushings such as 56 has an end wall 80 with a narrow aperture 82 therein. The aperture is large enough to pass a pin contact 18, while preventing the passage of the socket contact 36. Thus, the bushings serve not only to keep the signal socket contacts spaced from the plated walls of the hole, which are grounded, but also trap the socket contact in the hole.

The grounding device 60 includes a grounding socket contact 84 forming the first grounding socket 62, an opposite second grounding socket 86, and, middle portion 88 connecting them. The grounding socket contact is trapped within an electrically conductive grounding tube 90 formed by a pair of tube parts 92, 94. As mentioned earlier, the first grounding socket 62 is designed to receive a grounded pin or terminal 16G that will establish the contact 84 at ground potential. The opposite socket 86 is not required unless it is desired to transmit a ground potential to the other module. The socket contact 84 is in low resistance contact with the grounding tube 90. This can be accomplished by forming the grounding socket contact 84 from sheet metal that has been rolled into a tubular shape and which has been press fitted into the tube 90. Another way is to coat the inside of the tube and/or the outside of the grounding socket contact with solder and to solder them together during reflow soldering. It may be noted that applicant prefers to form the signal and grounding socket contacts 36, 84 so they are identical and with the two sockets such as 62, 86 of a socket contact being identical.

The plating 34 which coats the body 20, is a solderable plating. The grounding tube 90 is also coated with a solderable layer. After the grounding device 60 is inserted into the hole 26A (but preferably before the bushing devices and signal contacts 36 are installed), the entire assembly is subjected to heat. The heat causes reflow soldering of the plating in hole 26A to the outside of the grounding tube 90, to form a solder joint 96 (FIG. 4).

In many applications, it is desirable that the equivalent coaxial conductor formed by a signal socket contact 36 and the hole plating 34H that surrounds it, have a relatively high characteristic impedance such as 40 ohms. However, unless care is taken, a much lower characteristic impedance such as 16 ohms has been produced which leads to losses. The characteristic impedance is raised by constructing the couplings so the space 100 between each signal contact 36 and the plated walls of the hole is filled with material of a low dielectric constant. Plastics with low dielectric constants such as less than 3.0 generally have poor dimensional stability and poor environmental performance (they may soften at moderately high temperatures, have poor mechanical strength, and do not weather well). Plastics with high dielectric constants, such as more than 3.0, generally have good stability and good environmental performance (such plastics generally have long chain polymers). The stacking coupling generally must have high dimensional stability and environmental resistance, which is achieved by making the major part of it, the body 20, of a high performance plastic.

Applicant prefers to use a glass-filled liquid crystal polymer such as Vectra A-130 which has a dielectric constant of about 3.7. Applicant increases the characteristic impedance by constructing the bushing devices 44, 46 or at least the bushings thereof, of material of low dielectric constant. Applicant prefers to construct the bushing devices of polypropylene, which has a dielectric constant of about 2.3. The characteristic impedance is further increased by constructing the bushings so that they extend only a small distance A into each end of the hole, to leave a long bushing-free hole portion of length B between the ends of the opposite bushings. The space 100 is filled with air, which has a dielectric constant of about 1.0, to maximize the characteristic impedance. The air-filled distance B can be varied to "tune" the characteristic impedance to that of the rest of the system to achieve a matched impedance. Generally, the air-filled distance B is at least 25% of the total length C of the hole.

The coupling 10 can be constructed by first molding the body 20 with the numerous through holes therein, and then plating the entire surface of the body, including the holes, with an electrically conductive material. The holes to receive grounding devices are preferably plated with solder, and applicant prefers to plate the entire body with solder. Thereafter, applicant prefers to coat all of the plating with a dielectric coating to isolate it, except for the platings of holes 26A which will receive the grounding devices.

The grounding devices 60 are installed in selected holes of the body device, and the combination is heated for reflow soldering as described above. Then the second bushing device 46 is installed by pushing its bushings towards the second body face 24 and into the holes. Prior to installation, the bushing device is coating with an adhesive 102, so it will bond to the body device. The signal socket contacts 36 and the first bushing device 44 are installed through the opposite sides of the holes (the first bushing device having been coated with adhesive) to complete the assembly.

In one intermodule stacking coupling that applicant has designed, the coupling has a length of 1.17 inch, width of 0.508 inch, and thickness of 0.398 inch. It contains ninety-five holes, each of a diameter of 0.070 inch, each containing a dual entry socket constructed to receive pins of a diameter of 0.018 inch.

Figure 6:
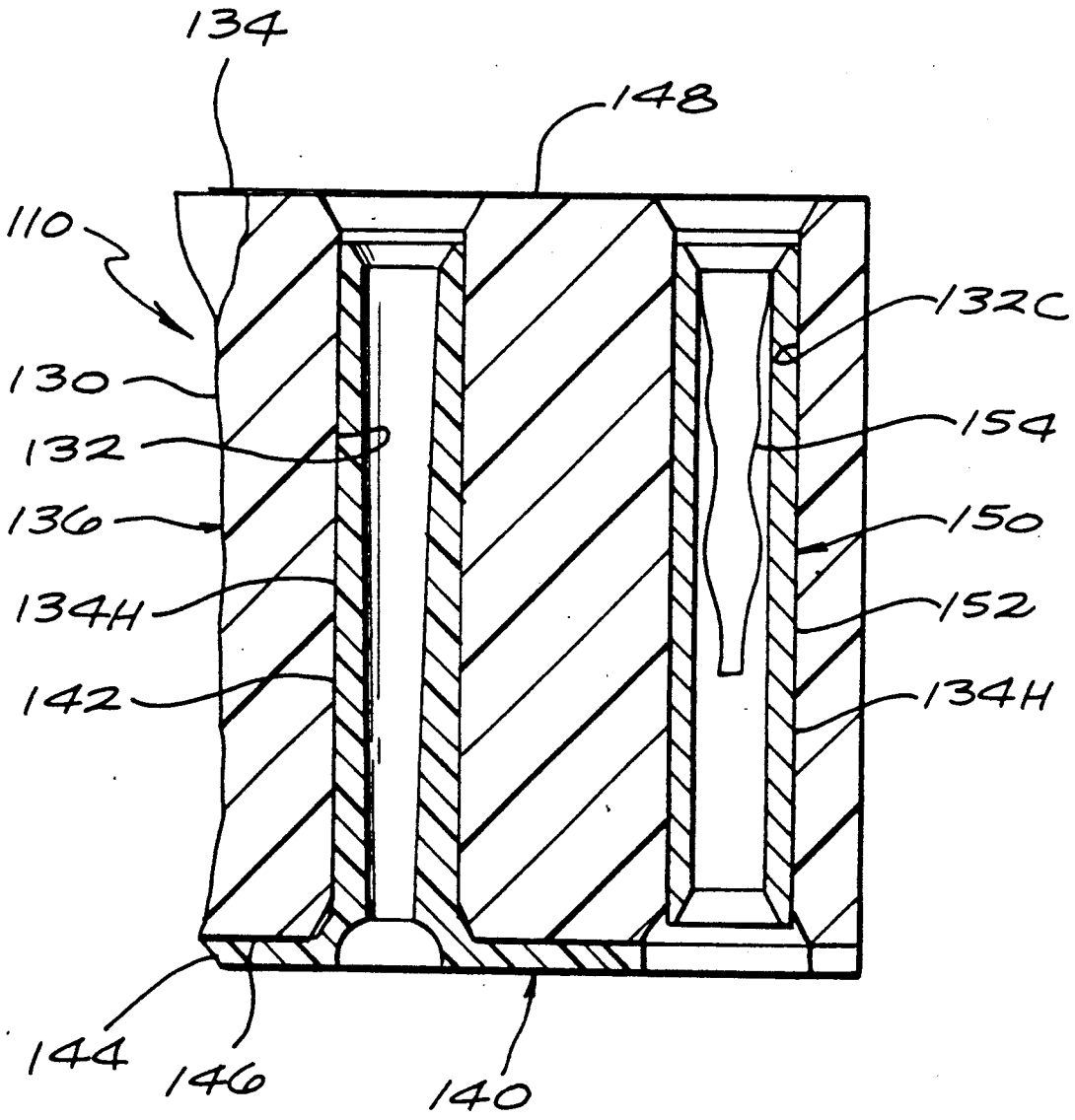
FIG. 6 is a partial sectional view of the coupling of FIG. 5.

FIGS. 5 and 6 illustrate another intermodule stacking coupling 110 which is designed to couple a pair of modules 112, 114, where the first module 112 has long pin contacts 116. The pin contacts 116 are designed to project completely through the coupling 110 and into plated through holes 120 in the second module 114. The coupling 110 keeps the modules spaced apart to avoid interference with electrical components indicated at 122, 124 on the two modules.

The pin contacts of the module 112 include two signal pin contacts 116A, 116B, and a grounded contact 116C. The coupling 110 is designed to provide an electromagnetic shield around each of the signal contacts 116A, 116B to prevent contact to contact interference between them along the space between the modules which is occupied by the coupling.

As shown in FIG. 6, the coupling 110 includes a body 130 with multiple holes 132, and a plating 134 that plates the entire body including the holes, to form a body device 136. A bushing device 140 includes a plurality of dielectric bushings 142 held on a plate 144 lying over a second face 146 of the body device that lies opposite the first face 148 thereof. In this case, the bushings 142 extend along most of the length of the holes. The bushings keep the signal pin contacts out of engagement with the plating 134H at the holes. The hole plating 134H is grounded, to provide an electromagnetic shield isolating the portions of the signal pin contact extending through the coupling. One of the holes 132C in the body device includes a grounding device 150. The grounding device includes a metal tube 152 and a socket contact 154 within the tube and securely mechanically and electrically connected to the tube. The tube 152 is, in turn, electrically connected to the plating 134H as by reflow solder. When the grounded pin contact 116C projects through the socket contact 154, it grounds it and the entire plating 134.

Thus, the invention provides an electrical coupling which has numerous holes which hold signal contacts, which provides an electrical (electromagnetic) shield around each signal contact to isolate it from other signal contacts, all in a relatively low cost and rugged construction. The coupling includes a body of dielectric material having a multiplicity of holes therein for receiving contacts. A plating of conductive material plates the walls of the holes and portions of at least one face of the body to interconnect the platings in the holes. This enables the plated walls of the holes to form an electromagnetic shield for contacts therein, when the plating is grounded. A plurality of dielectric bushings are provided that lie in the holes, to assure that signal contacts inserted into the holes are kept spaced from the plated walls of the holes so as to avoid short circuiting the signal contacts. The plating can be grounded by a grounding device that lies in one of the holes and that has a grounding contact for engagement with a source of ground potential, and which is electrically coupled to the plating in the hole. In one coupling, the bushings are short and project into opposite ends of each hole that holds a signal socket contact, with each bushing being formed integrally with a plate that holds a large number of bushings. The bushings are preferably of small enough length that a large portion of each hole is devoid of a bushing, so that only air lies between the middle of socket contacts in the hole and the plated walls of the hole. In another coupling, a single bushing extends along most of the length of each hole. The body is preferably formed of durable plastic which has a dielectric constant of more than 3.0 while the bushings can be formed of a less durable plastic with a dielectric constant of less than 3.0.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An intermodule stacking coupling which can lie between a pair of modules and receive contacts that electrically couple the modules, comprising:

a body of dielectric material having first and second opposite faces and having a multiplicity of through holes;

a conductive plating which plates each of said holes and portions of at least one of said faces to connect the platings in said holes, to thereby form interconnected plated hole walls;

first and second bushing devices, each including a plate and a plurality of dielectric bushings projecting from the plate, said plates of said first and second bushing devices lying respectively over said first and second body faces with said bushings projecting into said holes, each bushing having an end wall adjacent to said plate with an aperture in the end wall which is of smaller inside diameter than the rest of the bushing;

a plurality of pin-receiving socket contacts lying in said plurality of holes, within the two bushings in the hole between said end walls;

at least one grounding device lying in one of said holes that has plated walls, which is not occupied by said bushings, said grounding device having a pin-receiving grounding socket in contact with the plated walls of the hole.

2. The intermodule stacking coupling described in claim 1 wherein:

said body is formed of dielectric material having a dielectric constant of more than 3.0, said bushings are formed of material of a dielectric constant of less than 3.0.

3. An electrical coupling, comprising:

a body of dielectric material having opposite faces and having a multiplicity of holes for receiving contacts, said holes forming hole walls;

a plating of conductive material which plates said walls of said holes and portions of at least one of said faces that connect the platings in said holes, whereby to enable the plated walls of said holes to form an electromagnetic shield for contacts therein when the plating is grounded;

a first busing device which includes a first plate lying over a first of said body faces and a first plurality of bushings integral with said first plate and lying in a plurality of said holes;

a second bushing device which includes a second plate lying over a second of said body faces and a second plurality of bushings that are integral with said second plate and that project into said plurality of holes, so there are two bushings in each of said plurality of holes;

a plurality of socket contacts lying in said plurality of holes, each lying within the two bushings in the hole.

4. The coupling described in claim 3 including;

first and second modules lying adjacent to said first and second body faces, respectively, each module having a multiplicity of pin contacts projecting into said holes;

each of said socket contacts has opposite ends that each forms a socket, with a first of said sockets engaged with a pin of said first module and a second of said sockets engaged with a pin of said second module;

a grounding device forming at least one grounding socket lying in one of said holes that is not occupied by one of said bushings and in contact with the plated walls of the corresponding hole;

at least one of said modules has a grounded pin engaged with said grounding socket.

5. The coupling described in claim 3 wherein:

each of said bushings lying in one of said holes has a length that is small enough that at least one fourth of the length of each hole is devoid of a bushing between the plated hole wall and the contact lying in the hole.

6. An electrical coupling, comprising:

a body of dielectric material having opposite faces and having a multiplicity of holes for receiving contacts, said holes forming hole walls;

a plating of conductive material which plates said walls of said holes and portions of at least one of said faces that connect the platings in said holes, whereby to enable the plated walls of said holes to form an electromagnetic shield for contacts therein when the plating is grounded;

a plurality of dielectric bushings lying in a plurality of said holes, to keep contacts in said holes spaced from said plated walls of said holes;

first and second modules lying adjacent to said first and second body faces, respectively, with said first module having a multiplicity of pin contacts projecting completely through said body holes and said bushings therein, into said second module;

a grounding device forming a grounding socket lying in one of said holes that is not occupied by one of said bushings and in contact with the plated walls of said hole, and one of said contacts is engaged with said grounding socket.

7. A method for constructing an electrical coupling comprising:

forming a body of dielectric material having first and second faces and a multiplicity of holes therein;

plating said body with conductive material, including plating the walls of said holes and at least portions of one of said faces that interconnect said platings of said holes;

forming a plurality of dielectric bushings and inserting them into a plurality of said plated holes to form a passage surrounded by the plated walls of the holes but isolated from direct contact therewith;

said step of forming a plurality of bushings includes forming said bushings with large diameter tubular portions and with end walls having apertures of smaller diameters than said tubular portions;

said step of inserting said bushings includes inserting a pair of bushings into each of said plurality of holes, one into said first body face and the other into said second body face, with said end walls closest to said body faces; and including inserting a socket contact having opposite ends forming pin-receiving sockets into each of a plurality of said holes, before fully inserting one of each said pair of bushings into the corresponding hole, with the ends of the socket contacts of smaller diameter than said apertures to trap the socket contact within the pair of bushings in the hole.

8. A method for constructing an electrical coupling comprising:

forming a body of dielectric material having first and second faces and a multiplicity of through holes therein;

plating said body with conductive material, including plating the walls of said holes and at least portions of one of said faces that interconnect said platings of said holes;

forming a plurality of dielectric bushings and inserting them into a plurality of said plated holes to form a passage surrounded by the plated walls of the holes but isolated from direct contact therewith, to hold contacts out of engagement with the plated walls of the holes;

said steps of forming and inserting bushings includes leaving at least about 25% of the length of each hole free of a bushing, so only air lies between a contact in the hole and the plating on the walls of the hole.

* * * * *